United States Patent [19]

Labrijn

[11] Patent Number: 5,031,315

[45] Date of Patent: Jul. 16, 1991

[54] SHAVING APPARATUS

[75] Inventor: Hans Labrijn, Drachten, Netherlands

[73] Assignee: U.S. Philips Corporation, New York, N.Y.

[21] Appl. No.: 452,857

[22] Filed: Dec. 18, 1989

[30] Foreign Application Priority Data

Jan. 12, 1989 [NL] Netherlands ..... 8900071

[51] Int. Cl.[5] ..... B26B 19/04; B26B 19/14; B26B 19/06; B26B 19/28

[52] U.S. Cl. ..... 30/41; 30/41; 30/43.4; 30/43.6; 30/44

[58] Field of Search ..... 30/41, 44, 44.5, 34, 30/41.5, 41.6, 43.1–43.6, 43.7, 346, 51

[56] References Cited

U.S. PATENT DOCUMENTS

| | | | |
|---|---|---|---|
| 3,431,643 | 3/1967 | Miceli | 30/43.4 |
| 3,967,372 | 7/1975 | Beck et al. | 30/43.1 |
| 4,675,998 | 6/1987 | Thijsse | 30/43.6 |
| 4,819,330 | 4/1989 | Fenn et al. | 30/44 |
| 4,903,404 | 2/1990 | Labrijn | 30/43.6 |

*Primary Examiner*—Douglas D. Watts
*Assistant Examiner*—Paul M. Heyrana, Sr.
*Attorney, Agent, or Firm*—Ernestine C. Bartlett

[57] ABSTRACT

A dry-shaving apparatus having a drivable shaving member is provided with a separately drivable vibration device for cleaning purposes.

12 Claims, 3 Drawing Sheets

SHAVING APPARATUS

FIELD OF THE INVENTION

This invention relates to a dry-shaving apparatus comprising a drivable shaving member.

BACKGROUND OF THE INVENTION

Such an apparatus is known, for example, from U.S. Pat. No. 4,675,998. The shaving particles are collected in the apparatus and partly stick to the walls and to the shaving member. It has been found that in practice the apparatus is not cleaned thoroughly, for example by means of an accessory brush, after every shave. Generally, the apparatus is merely opened and is held upside down above a wash-basin or a dustbin. Usually, while this is down, taps are given on the apparatus or the apparatus is tapped against the wall of the basin or bin. The apparatus is then very likely to be damaged.

SUMMARY OF THE INVENTION

An object of the invention is to facilitate cleaning of the apparatus and to preclude the above-mentioned harmful treatment, and to this end the invention is characterized in that the apparatus comprises a separately drivable vibration device for cleaning purposes.

The vibration mechanism produces a multitude of gentle taps having the same effect as tapping by hand but without any harmful consequences for the apparatus. Moreover, the vibration mechanism can be constructed in such a way that in particular those parts of the apparatus are made to vibrate which are most likely to be soiled.

In preferred embodiments of the invention, an electric motor for driving the shaving member also serves to drive the vibration device; and/or the shaving apparatus comprises a rotatable shaving member and has a direction of rotation of the electric motor which corresponds to the shaving action of the shaving member, a claw coupling being arranged between the electric motor and the shaving member wherein the motor can be switched to an opposite direction of rotation for which direction of rotation the claw coupling also constitutes the vibration device and/or the vibration device comprises a rotatable element having projections and a movable pin; and/or the apparatus comprises at least one rotatable shaving member and a trimmer, which trimmer is constructed to be coupled to the electric motor by means of a drive mechanism in order to drive the shaving member, and wherein the drive mechanism is coupled to the drive mechanism for the trimmer.

BRIEF DESCRIPTION OF THE DRAWING

Some embodiments of the invention will now be described in more detail, by way of example, with reference to the Figures.

DETAILED DESCRIPTION OF THE INVENTION

Figure 1:
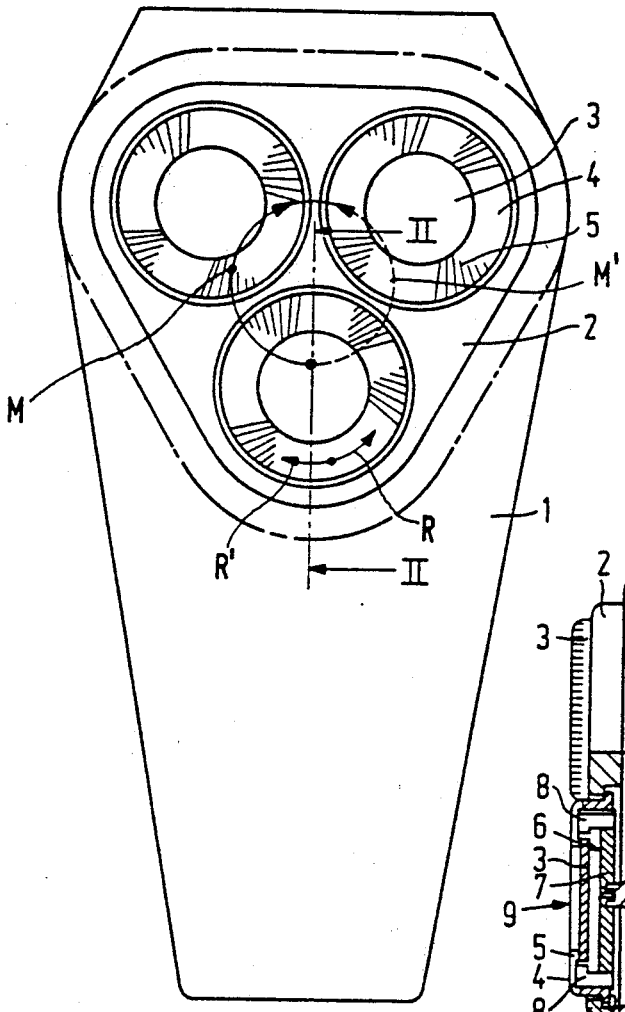
FIG. 1 is a plan view of a shaving apparatus comprising three shaving units.
Figure 2:
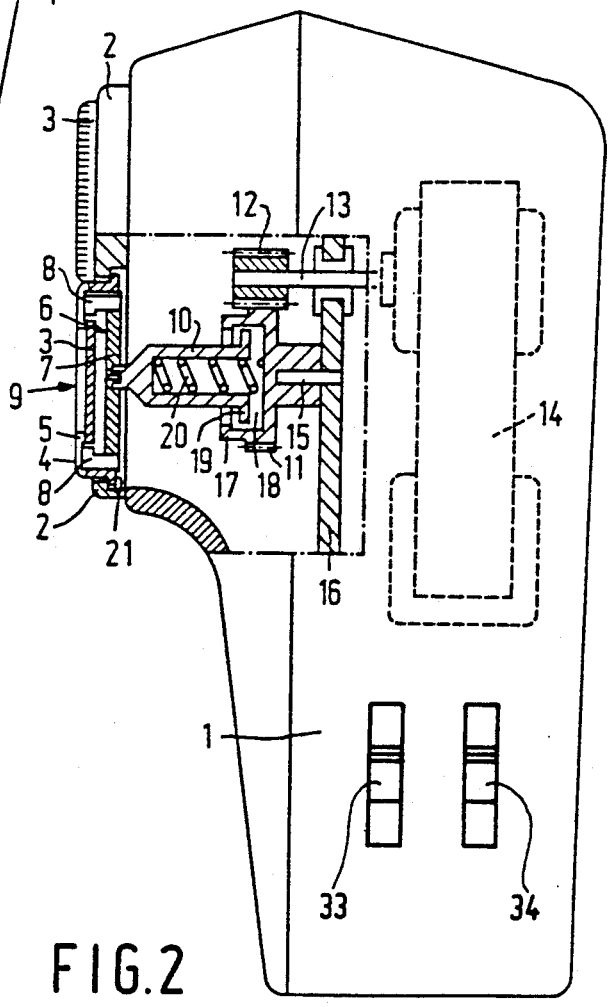
FIG. 2 shows the shaving apparatus in a side view and partly in a sectional view taken on the line II—II in FIG. 1.

The shaving apparatus shown in FIGS. 1 and 2 comprises a housing 1 of which a part is constructed as a holder 2 for three external shaving members 3. Each external shaving member 3 has an annular shaving portion 4 with hair entry apertures 5.

The sectional part of FIG. 2 shows a drivable internal shaving member 6 arranged at the inner side of an external shaving member 3, which for the sake of clarity is shown only diagrammatically in FIG. 2. Each internal shaving member 6 comprises a central body 7 carrying a set of circumferential cutters 8 which face the shaving portion 4. Each external shaving member 3 and the associated internal shaving member 6 together form a shaving unit 9.

By means of a coupling spindle 10, gear wheels 11 and 12, and a shaft 13 the internal shaving member 6 is coupled to a drive mechanism, generally an electric motor 14 to isolate the internal shaving member 6 relative to the associated external shaving member 3. The gear wheel 11 is journalled on a pin 156 mounted in a mounting plate 16. The gear wheel 11 has a hub 17 with an internal recess 18. To transmit the rotary movement of the gear wheel 11 to the associated coupling spindle 10 one end of the coupling spindle is provided with a non-round flange 19 which engages in a recess 18 of a corresponding shape. Moreover, the shaving unit is supported by the coupling spindle 10 by means of a resilient pressure element, constructed as a helical spring 20 which for the greater part is situated within the coupling spindle 10. This helical spring 20, which is compressed between the coupling spindle 10 and the gear wheel 11, exerts a force on the coupling spindle which is directed towards the shaving unit 9. This force is transmitted to the internal shaving member 6 via the coupling spindle 10 and to the external shaving member 3 via the internal shaving member, so that the rim 21 of the external shaving member 3 is pressed against the holder 2. The external shaving member 3, together with the internal shaving member 6 and the coupling spindle 10, can be pressed inwards against the action of the resilient element 20 by external forces such as those which may occur for example during use of the shaver.

The coupling to the electric motor 14, as described above, is identical for the three internal shaving members 6 of the apparatus shown in FIGS. 1 and 2, in which the three gear wheels 11 mesh with the single central gear wheel 12 on the motor shaft 13.

Figure 3:
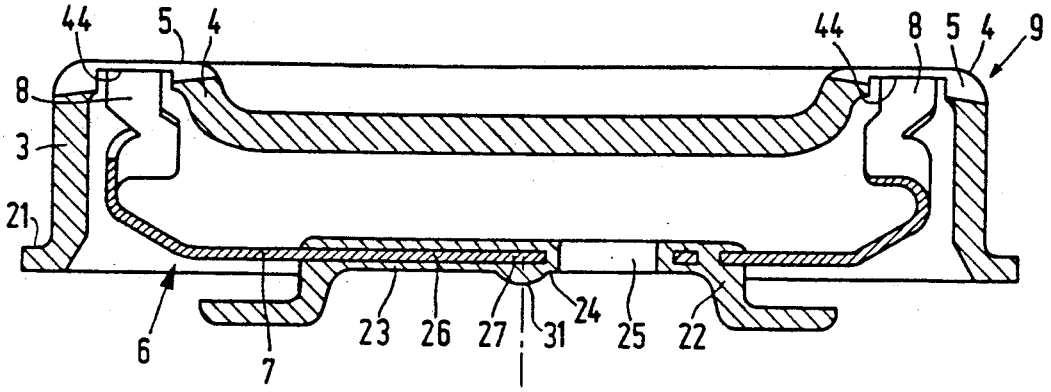
FIG. 3 is a sectional view of a shaving unit.
Figure 4:
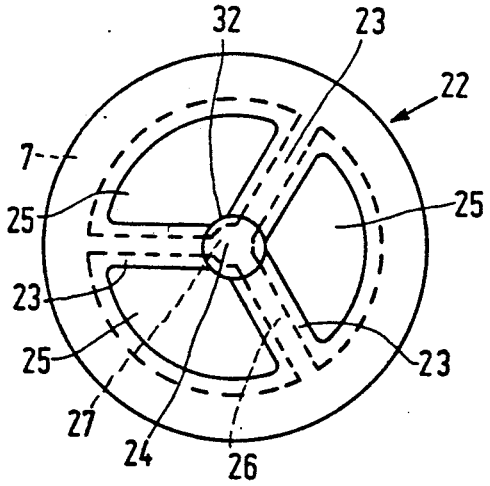
FIG. 4 is an underneath view of the coupling member of the internal shaving member shown in FIG. 3.

The internal shaving member 6 is provided with a coupling member 22 (FIGS. 3 and 4), for example made of a plastics, comprising three spokes 23 radiating from and interconnected by a central annular portion 24. Between the spokes coupling apertures 25 are formed. The coupling member 22 partly encloses the central body 7 of the internal shaving member 6, which is constructed accordingly, comprising spokes 26 and a central portion 27, which central body 7 is integral with the cutters 8.

Figure 5:
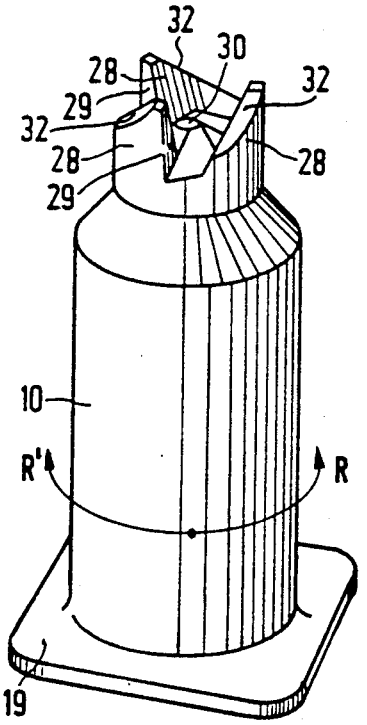
FIG. 5 is a perspective view of the coupling spindle.

The end of the coupling spindle 10 (FIG. 5) carries three coupling fingers 28, which in the assembled condition of the apparatus engage in the apertures 25 and whose front faces 29 abut the spokes 23, so that the coupling spindle 10 is coupled to the internal shaving member 6 to rotate this member in the direction of rotation R. The coupling spindle 10 has a central pressure surface 30 which bears against the lower surface 31 of the central portion 24. At their ends the coupling fingers 28 have a slightly pointed shape, their surfaces 32 which are situated at the rear relative to the direction of rotation R, being inclined. When the holder with the shaving members is placed onto the apparatus this pointed shape facilitates entry of the coupling fingers 28 into the apertures 25. In this way the coupling fingers 28 and the spokes 23 form a so-called claw coupling.

The direction of rotation R of the coupling spindle 10 and the drivable shaving member 6, which corresponds to the shaving action of this shaving member, corresponds to a direction of rotation M (FIG. 1) of the electric motor 14. If the direction of rotation of the motor is reversed, for example by changing the polarities of the poles, so that an opposite direction of rotation M' is obtained, the coupling spindles 10 will also be driven in the opposite direction of rotation R'. The inclined surfaces 32 of the coupling fingers 28 then come into contact with the spokes 23. As a result of this, the coupling fingers 28 are pressed out of the apertures 25, so that the coupling spindles are displaced substantially in a direction away from the shaving members, against the action of the springs 20. By rotating a coupling spindle 10 relative to the associated internal shaving member 6 the coupling fingers 28 will reach the next apertures 25, causing the coupling spindle to slip back into an aperture, its pressure surface 30 striking against the lower surface 31 of the internal shaving member 6.

This process repeats itself, so that in this way the claw coupling (23, 28) operated as a vibration mechanism which, for example, for a motor speed of 9000 revolutions per minute and a 5:1 reduction ratio between the motor and the coupling spindle has a frequency of 90 strokes per second. Shaving particles sticking to the shaving members can be loosened by means of the vibration mechanism, after which they are collected in the space between the shaving units 9 and the mounting plate 16. After removal of the holder with the shaving members these shaving particles can be removed simply from said space by means of a brush. The vibration mechanism thus provides cleaning of the shaving members, so that these shaving members have to be cleaned less frequently or not at all. However, the vibration will also be transmitted to other parts of the shaving apparatus, so that hair particles and other contaminants sticking thereto will also come loose as a result of the vibrations, after which they are easy to remove.

To reverse the direction of rotation of the motor 14 the shaving apparatus may comprises a separate reversal switch 34 (FIG. 2), adjacent the on/off-switch 33.

It is also possible that, after the apparatus has been switched off, the motor is re-started automatically, for example electronically, in the reverse direction of rotation for a short time, for example three seconds.

The invention is particularly suitable for use in shavers in which the holder 2 can be removed from the apparatus but the shaving units 9 remain mounted on the apparatus, as is described for example in EP-A-88202108.2 which corresponds substantially to U.S. Pat. No. 4,934,051 issued June 19, 1990. When the holder has been removed the apparatus can be held above a washbasin or dustbin, so that the hair particles are removed immediately once the vibration mechanism is started.

When the coupling spindle 10 is rotated in the opposite direction of rotation R' the friction between the internal shaving member 6 and the external shaving member 3 will generally be adequate to prevent the internal shaving member 6 from being rotated with the coupling spindle 10.

Figure 6:
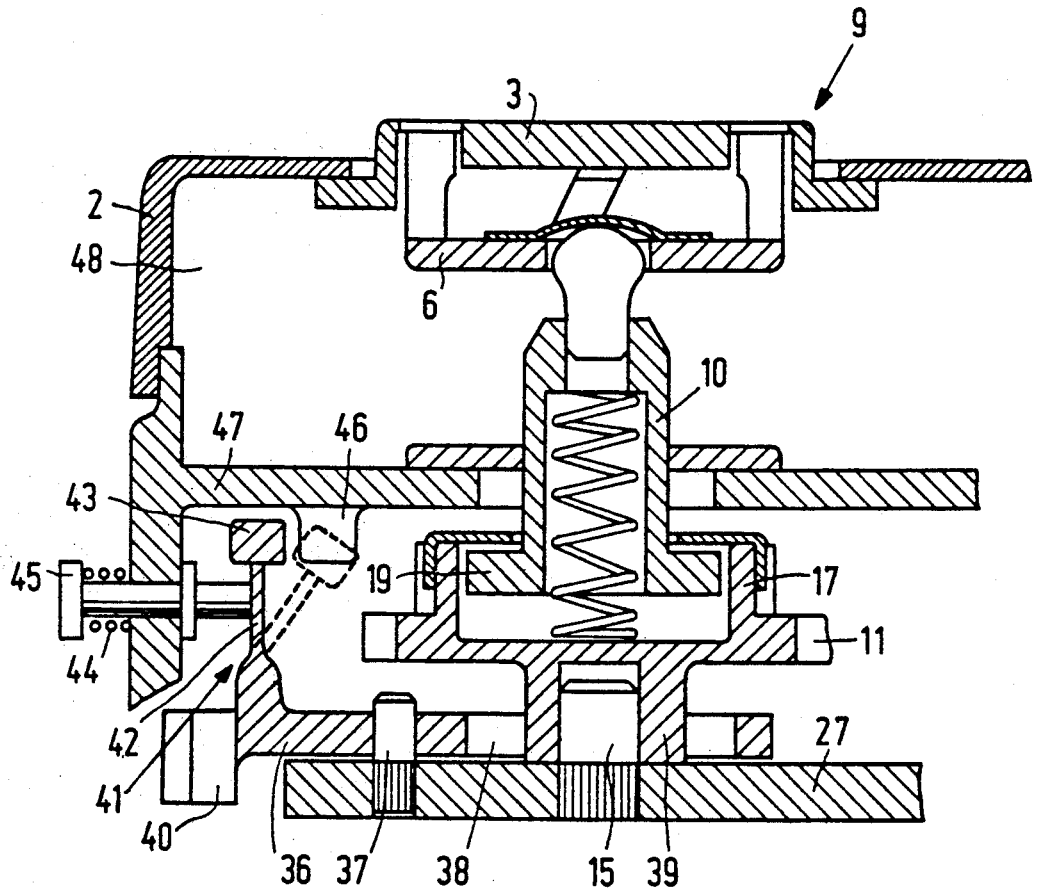
FIG. 6 shows another embodiment in a partly sectional view similar to that of FIG. 2.
Figure 7:
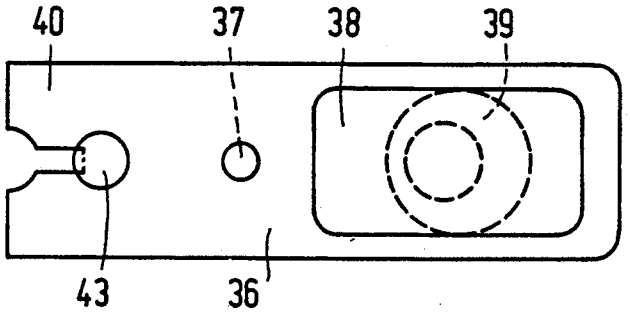
FIG. 7 is a plan view showing the drive lever for the trimmer and the vibration mechanism of the embodiment shown in FIG. 6.

In the embodiment shown in FIGS. 6 and 7 corresponding parts bear the same reference numerals as in FIGS. 1 to 5. THe apparatus has at least one shaving unit 9 comprising a rotatable shaving member 6. The apparatus also has a trimmer which, for simplicity, is not shown, but which is driven by means of a lever 36 which is pivotable about the spindle 37. One end of the lever 36 is formed with a slot 38 in which the eccentric 39 is situated. This eccentric 39 may, for example, form part of the hub 17 with the gear wheel 11. Thus, when the hub 17 is rotated the lever 36 will perform an oscillatory rotation about the spindle 37. The other end has a U-shaped coupling portion 40 to drive a trimmer. This end also carries a striker 41 comprising an elastic shank 42 and a head 43. By means of the pin 45, which is slightly depressible against the action of the spring 44, the shank can be deflected slightly so that the head 43 comes within range of an anvil 46. This anvil is, for example, integral with the bottom 47 of the collecting chamber 48 for shaving particles. As a result of the oscillatory rotation of the lever 36 the head 43 will strike against the anvil 46 with a frequency corresponding to the speed of the hub 17. Hair particles and other contaminants will come loose as a result of the action of this vibration mechanism, which simplifies cleaning of the apparatus. If the strokes of the vibration mechnism (36, 41, 46) are powerful enough the vibrations will also be transmitted to other parts of the apparatus, such as the holder 2 with the shaving members 3 and 4.

In another embodiment of a vibration mechanism, which is not shown in the Figures, one of the rotationally driven parts of the apparatus, for example the hub 17, comprises projections which are equidistantly spaced along the circumference of the hub. A slightly elastic pin, corresponding to the pin 45 in FIG. 6, can be depressed so as to be brought into contact with said projections. During the rotation the projections strike against the pin, so that again the adjoining parts of the shaving apparatus are set into vibration and adhering contaminants become detached.

I claim:

1. A dry-shaving apparatus comprising a drive mechanism, a drivable rotatable shaving member operatively coupled to the drive mechanism, and a separately drivable vibration device for cleaning purposes, the drive mechanism being adapted to drive both the drivable shaving member and the vibration device.

2. A dry-shaving apparatus as claimed in claim 1, wherein the drive mechanism is an electric motor for driving both the drivable rotatable shaving member and the vibration device.

3. A dry-shaving apparatus as claimed in claim 2, comprising a rotatable shaving member and having a direction of rotation of the electric motor corresponding to the shaving action of the shaving member, and a claw coupling arranged between the electric motor and the shaving member, wherein the motor can be switched to an opposite direction of rotation, for which direction of rotation the claw coupling also constitutes the vibration device.

4. A dry-shaving apparatus as claimed in claim 1 or 2, wherein the vibration device comprises a rotatable element having projections and a movable pin.

5. A dry-shaving apparatus as claimed in claim 1, comprising at least one rotatable shaving member and a trimmer, which trimmer is constructed to be coupled to an electric motor by means of a drive mechanism in order to drive the shaving member, wherein the drive mechanism for the shaving member is coupled to the drive mechanism for the trimmer.

6. A dry-shaving apparatus including a shaving unit comprising an external shaving member provided with hair entry apertures; an internal shaving member associated with and rotatable relative to the external shaving member; a resilient element engaging the internal shaving member and exerting pressure thereon; coupling means comprising a coupling spindle having a pressure surface which bears against a surface of the internal shaving member and couples said internal shaving member to a drive mechanism for the shaving unit, wherein said internal shaving member is provided with a coupling member comprising spokes radiating from and interconnected by a central portion and coupling apertures formed between the spokes, the end of the coupling spindle having fingers which engage in the coupling aperture of the coupling member whereby the internal shaving member is rotated in a direction of rotation R, the coupling spindle being drivable in the opposite direction of rotation R′ when the direction of rotation of the drive mechanism is reversed.

7. A dry-shaving apparatus as claimed in claim 6 wherein said spokes of the coupling member and ends of the coupling spindle form a claw-coupling arranged between the drive mechanism and the shaving member.

8. A dry-shaving apparatus as claimed in claim 6 wherein the direction of rotation R of the coupling spindle and of the shaving member corresponds to the shaving action of said internal shaving member and to a direction of rotation M of an electric motor drive mechanism, the coupling spindle being driven in an opposite direction of rotation R′ when said motor effects an opposite direction of rotation M′.

9. A dry-shaving apparatus as claimed in claim 8 wherein the opposite direction of rotation M′ of said motor is effected via a separate reversal switch.

10. A dry-shaving apparatus including a shaving unit comprising an external shaving member provided with hair entry apertures; an internal shaving member associated with and rotatable relative to the external shaving member; a collecting chamber for shaving particles; a resilient element engaging the internal shaving member and exerting pressure thereon; and a vibration mechanism which comprises an anvil formed integral with a bottom wall of said collection chamber, and a lever which is pivotable about a spindle, one end of said lever being formed with a slot in which an eccentric which forms a part of a hub is situated, the other end of said lever carrying a striker which is situated in close proximity to said anvil whereby rotation of the hub effects oscillatory rotation of the lever about the spindle which oscillatory rotation causes the striker to strike against the anvil.

11. A dry-shaving apparatus as claimed in claim 10 wherein the striker has an elastic shank and a head and said vibration mechanism includes a pin depressible against the action of a spring whereby the shank can be deflected so that the head comes within striking range of the anvil.

12. A dry-shaving apparatus as claimed in claim 10 wherein the striker strikes the anvil with a frequency corresponding to the speed of the hub.

* * * * *